US005427310A

United States Patent [19]

Testa, Jr.

[11] Patent Number: 5,427,310

[45] Date of Patent: Jun. 27, 1995

[54] CARTONS OF THE GABLE TYPE PROVIDED WITH SEAL BREAKING PULL CORDS

[76] Inventor: Vincent M. Testa, Jr., 61 Ober St., Beverly, Mass. 01915

[21] Appl. No.: 143,102

[22] Filed: Oct. 29, 1993

[51] Int. Cl.[6] ..... B65D 5/06; B65D 5/08; B65D 5/74

[52] U.S. Cl. ..... 229/249; 229/239

[58] Field of Search ..... 229/214, 248, 249, 239

[56] References Cited

U.S. PATENT DOCUMENTS

| | | | |
|---|---|---|---|
| 2,198,119 | 4/1940 | Krengel | 229/51 |
| 2,268,668 | 1/1942 | Moore | 229/239 |
| 3,186,621 | 6/1965 | Svenson | 229/17 |
| 4,027,455 | 6/1977 | Rausing et al. | 229/239 |
| 4,433,784 | 2/1984 | Kjelgaard | 229/248 |
| 4,821,950 | 4/1989 | Sanchez et al. | 229/249 |

FOREIGN PATENT DOCUMENTS

| | | | |
|---|---|---|---|
| 8203370 | 10/1982 | WIPO | 229/239 |

*Primary Examiner*—Stephen P. Garbe
*Attorney, Agent, or Firm*—Abott Spear

[57] ABSTRACT

Cartons having gabled ends which when opened form pouring spouts are provided with seal breaking pull cords. Each pull cord has first and second ends and an intermediate length. Each first cord end is anchored in the seal adjacent that portion thereof that is to be ruptured. The second end may be within the seal adjacent the other end of that portion or it may protrude from that end.

5 Claims, 6 Drawing Sheets

CARTONS OF THE GABLE TYPE PROVIDED WITH SEAL BREAKING PULL CORDS

BACKGROUND OF THE INVENTION

Cartons having their upper end sealed and in the form of oppositely disposed, aligned gables are widely used as containers for such liquids as milk and juices. Such cartons are well accepted as they are dimensioned for convenient storage and once opened can be repeatedly closed and opened and are easily disposed of when emptied.

Such cartons are formed from blanks provided with established fold lines which (in the case of a gable to be converted into a pouring spout) establish side walls having upper portions which are inclined toward each other and end walls having upper portions consisting of central and marginal triangular sections. The central sections are inclined towards each other and the marginal sections are inclined upwardly with their margins sealed together and to the upper portions of the side walls which also have fold lines defining triangular sections similar to the sections sealed thereto. The fold lines of the blanks are in the form of small channels.

The conversion of a gable into a pouring spout includes the steps of first forcing the two marginal sections of the end wall apart to break the seal between them. With the two marginal sections positioned to establish an angle of at least 180°, the marginal triangular sections are pushed forwardly and upwardly to rupture the seal between them and the similar upper portions of the side walls.

Usually, the cartons are easily opened following this procedure but frequently the procedure is unsuccessful making it necessary to sever the seals, as with a knife.

THE PRESENT INVENTION

The general objective of the present invention is to provide cartons of the type having their upper ends closed and sealed in a manner such that the closed ends have gables one of which is to be opened to provide a pouring spout. In accordance with the present invention, the gable seal between the sections of the end and side walls of said one gable is provided with a pull cord one end of which is anchored in the heat treated adhesive and the other end is exposed and digitally engageable adjacent the opposite section and so spaced from the anchored end that by pulling the exposed end towards it, the seal is broken or so weakened that seal breakage is assured when the usual opening procedures are followed.

Other objectives, novel features of the invention will be apparent from the drawings which illustrate the presently preferred embodiment, the description thereof and the claims.

BRIEF DESCRIPTION OF THE DRAWINGS

The accompanying drawings illustrate a presently preferred embodiment of the invention

THE PREFERRED EMBODIMENTS

While the invention is concerned only with the addition of pull cords to cartons of the type having sealed gables, a full description of such a carton is necessary to ensure the proper relationship of the pull cords to the seals.

Figure 1:
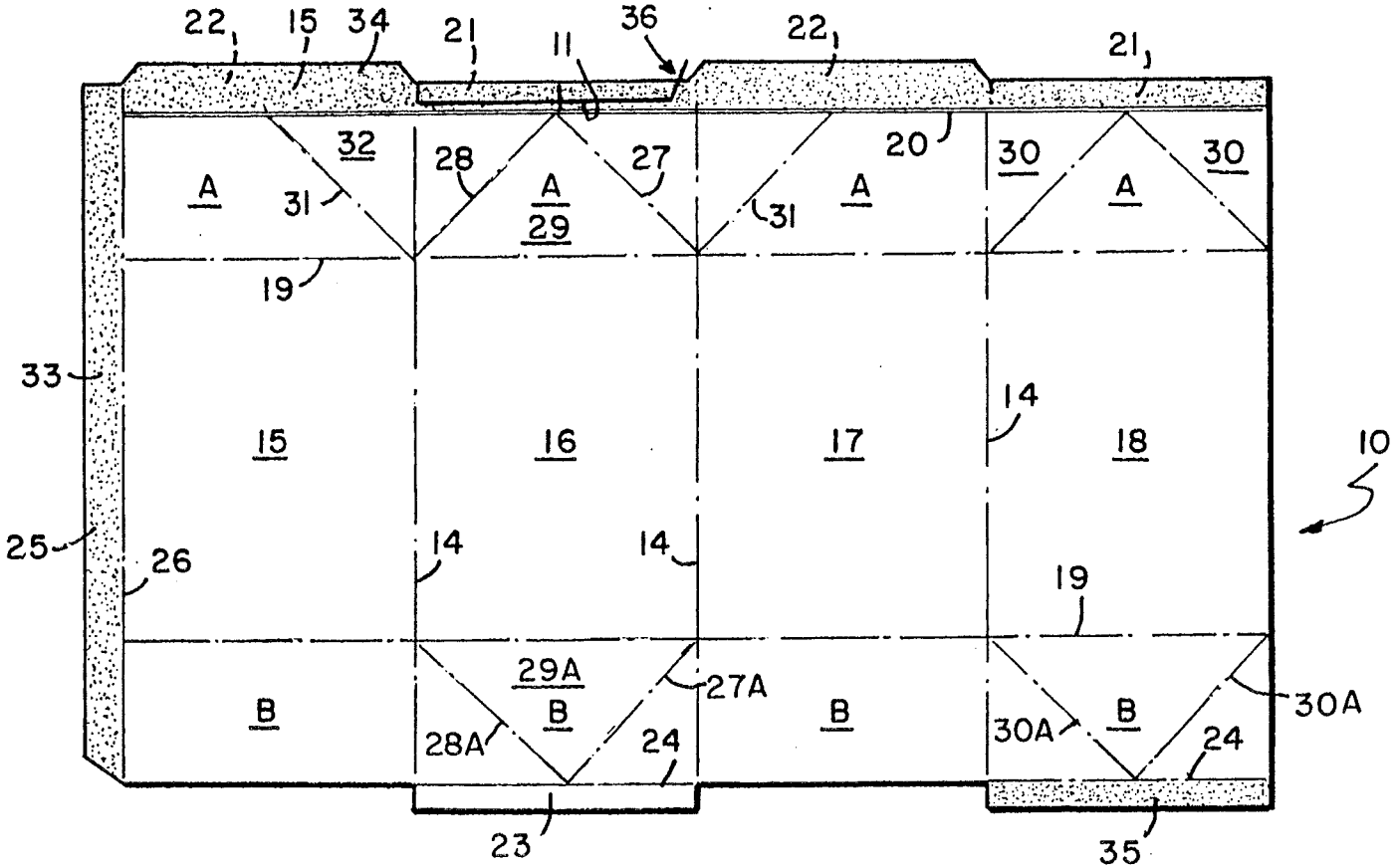
FIG. 1 is a plan view of a blank ready to be folded to establish a gabled carton and having a pull cord held by the upper margin of that portion of the blank which is to form the front wall of the carton.

In FIG. 1, a blank, generally indicated at 10, is conventional except for the pull cord 11 and is ready to be folded to form a carton 12, heat sealed with the bottom of the carton fiat and rectangular in cross section and with an open, upper end. After the carton has been filled with milk, juice or other liquids, the upper end is closed by heat seals with the sealed upper end having gables at each end. The gables are generally indicated at 13. The blank 10 is substantially rectangular and is provided with fold lines such that the carton will have the above characteristic features. As stated earlier, the fold lines establish minute channels on the surfaces of the blank which become the exterior surfaces of the cartons 12.

To that end, the blank 10 has a series of parallel, transverse fold lines 14 to establish four walls, left to right in FIG. 1, a side wall 15, a front wall 16, the opposite side wall 17 and the back wall 18.

The front wall 16 and the back wall 18 are identical and have first or upper end portions A and second or lower end portions B. The several end portions are established by spaced, parallel fold lines 19 which extend the full length of the blank 10.

Each of the A portions of the four walls is of such width as to include a tab defined by a lengthwise fold line 20, the tabs 21 in the case of the end walls 16 and 18 and the tabs 22 in the case of the side walls 15 and 17, the tabs 22 slightly wider than the tabs 21. Similarly, each of the portions B of the end walls 16 and 18 is wider than the portions B of the side walls 15 and 17 and has a marginal tab 23 established by fold lines 24 in alignment with the free edges of the portions B of the side walls 15 and 17.

The side wall 15 has a tab 25 extending along its free edge and is defined by a fold line 26 parallel to the fold lines 14, the side walls 15 and 17 otherwise identical.

The portions A and B of the end walls 16 and 18 have additional fold lines necessary for the formation of the gables 13. Fold lines 27 and 28 commence at opposite ends of the lengths of the fold lines 19 in each of the end walls 16 and 18 and those fold lines are inclined towards each other and meet at the centers of the appropriate part of the fold line 20 so that the portions A and B of the end walls have fold lines which define a central isosceles triangle 29 between right triangles 30.

Each of the portions A of the side walls 15 and 17 has a fold line 31 which extends to the fold line 20 from the junction of the fold line 19 with the appropriate fold line 14 bordering the portions A of the front wall 16 and parallel to the fold line 19 of the A portions thereof establishing a right angular section 32 similar to the section 30. Each of the portions B of the end walls 16 and 18 has fold lines 27A and 28A defining triangles 29A and 30A similar, respectively, to the triangles 29 and 30.

As previously stated, the blank 10, as shown in FIG. 1, is ready to be folded and accordingly an adhesive of a type which can be converted into a seal by heat has been applied to areas where seals are to be established. A covering band of adhesive 33 extends the full length of the tab 25, a like band 34 extends the full length of and covers the tabs 21 and 22. The tab 24 of the rear wall 18 is also provided with an adhesive coat 35.

When the blank 10 is folded to form a carton 12, the tab 25 is heat sealed to the proximate margin of the rear wall 18, the portions B of the four walls overlap one another to form a fiat carton bottom when heat sealed with such an arrangement made possible by the fold lines 28 and 29 in the tabs of the portions B of the end walls.

Figure 3:
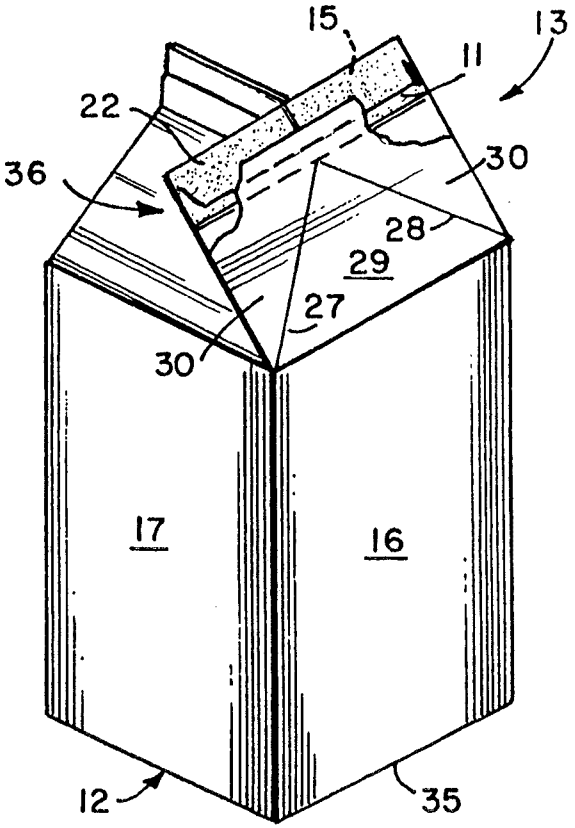
FIG. 3 is a like view of the carton but with the two marginal triangular sections of the front wall and corresponding sections of the side walls disposed to define an angle of at least 180° and the seal between the two marginal sections of the front wall broken.
Figure 2:
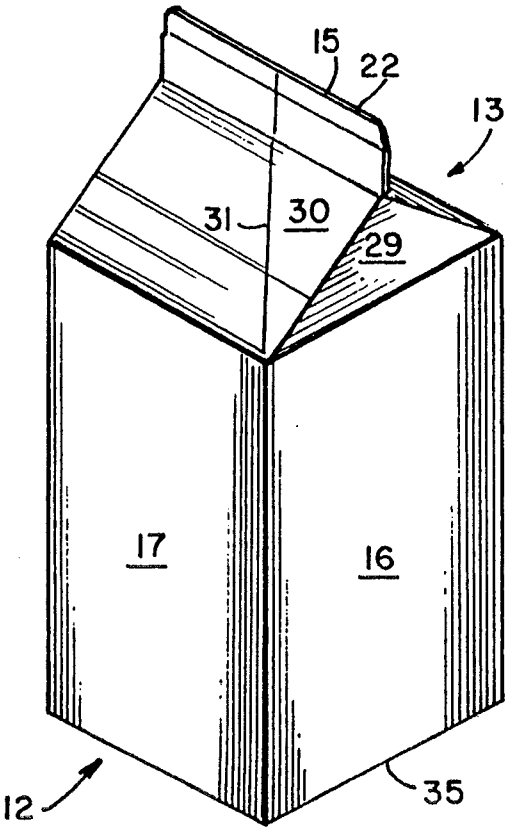
FIG. 2 is a perspective view of the carton after being filled.
Figure 5:
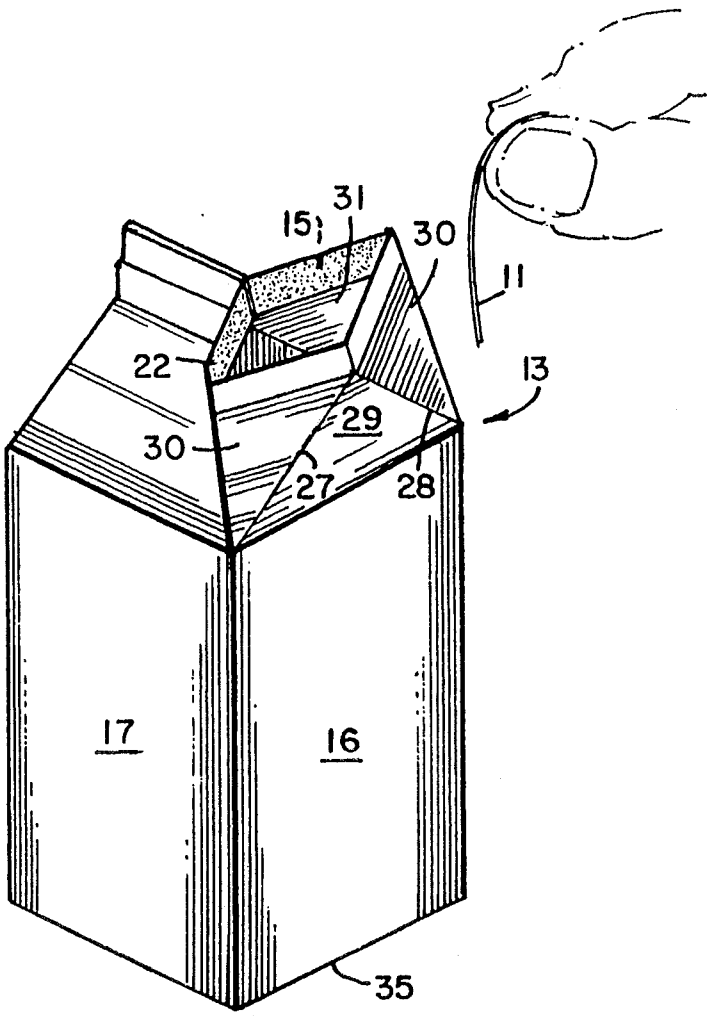
FIG. 5 is yet another like view but with the pull cord pulled free and the gable converted into a pouring spout.
Figure 4:
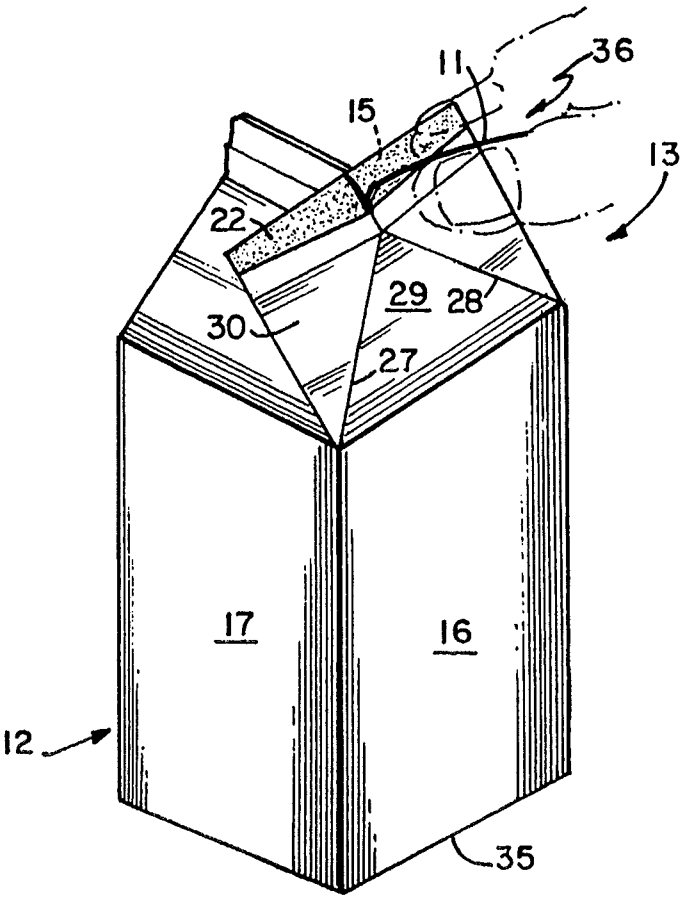
FIG. 4 is another like view of the carton illustrating the rupturing by the pull cord of the seal between the two triangular sections of the gable side walls and the corresponding sections of the front wall.

In the case of the open upper end of the carton 13, after the carton has been filled, the portions A of the side walls 15 and 17 are inclined towards each other with their adhesive coated tabs 22 in mutual contact. The sections 29 of the end walls are inclined inwardly towards each other with the sections 30 folded to permit their positioning in that gable forming manner and their adhesive coated tabs to come into mutual contact so as to enable the abutting tabs to be heat sealed together. When the carton 13 is to be opened, the two sections 30 are pushed apart, into the position shown in FIG. 3 and then pushed upwardly and towards each other to break apart the seal locking the portions A of the front wall to the sections 30 of the side walls with freed sections 29, 30 and 32 providing a pouring spout, see FIG. 4.

In accordance with the embodiment of the invention illustrated by FIGS. 1–7, one end of the pull cord 11 is incorporated in the adhesive coat adjacent the remote end of one section 30 with its other end embedded in the adhesive adjacent the remote end of the other section 30 with said other end available to be digitally released and gripped. When thus gripped and pulled towards the anchored end, the heat sealed adhesive is severed by the cord until pulled free. It is preferred that the pull cord be sterile and with its length between its ends free of and close to but above the channel formed by the fold line, establish the tab of the portions A of the front wall 16.

Figure 6:
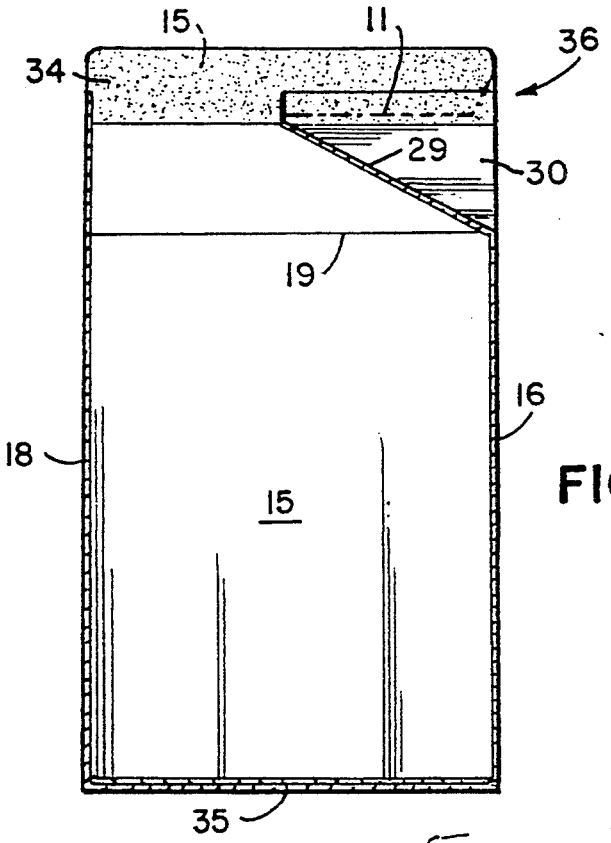
FIG. 6 is a section taken lengthwise through the seals of the gable to be opened.
Figure 7:
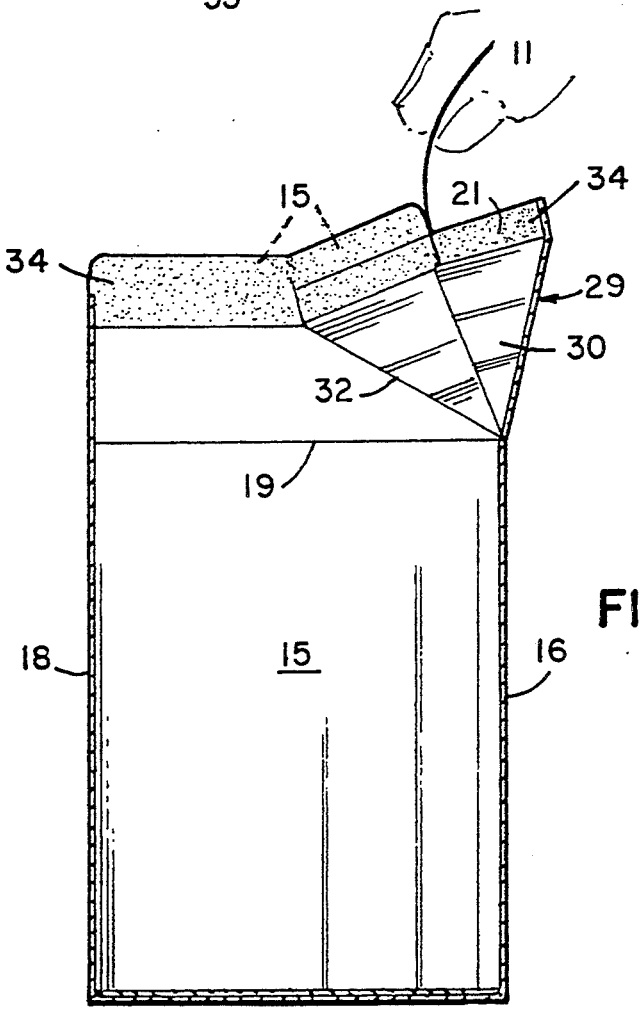
FIG. 7 is a view illustrating the pull cord being pulled free and the gable converted into a pouring spout.
Figure 6A:
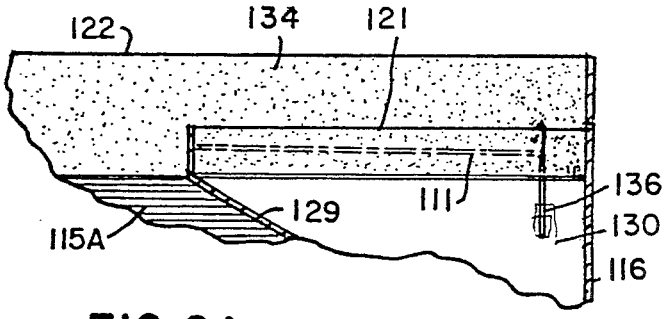
FIG. 6A is a fragmentary view, otherwise similar to FIG. 6 but illustrating another embodiment of the invention.
Figure 7A:
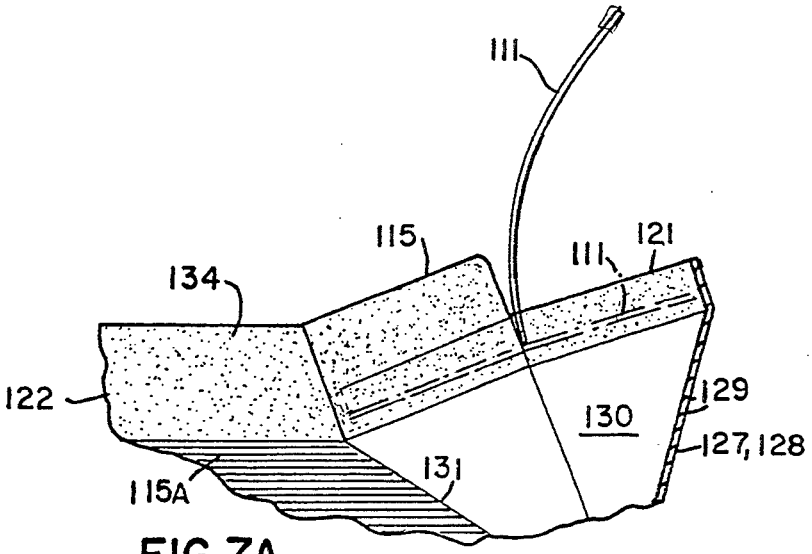
FIG. 7A is a fragmentary view illustrating the removal of the pull cord of FIG. 6A with the gable converted into a pouting spout.
Figure 8:
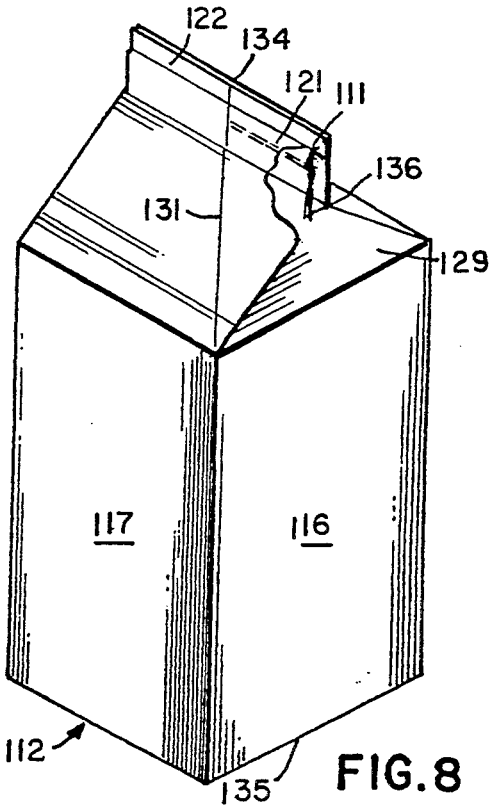
FIG. 8 is a view of a carton in accordance with the embodiment of the invention illustrated by FIGS. 6A and 7A with the gable to be opened partly broken away to expose the free end of the pull cord.

FIGS. 6A, 7A and 8 illustrate another embodiment of the invention with parts which correspond to those of the first described embodiment identified by the same reference numerals which are distinguished by the prefix "1".

As shown in FIGS. 1 and 6, the pull cord 11 has both ends anchored in the adhesive which seals the triangular sections 30 to the corresponding sections 32 of the side walls 15 and 17 of the gable to be opened, the intermediate length of the pull cord 11 free of and close to the lower edge of the adhesive band 34, desirably above the fold line 20.

In FIGS. 6 and 6A, both ends and the intermediate length of the pull cord 11 and 111 are within the adhesive band 34 and 134. In either embodiment, the end of the pull cord which is to be digitally gripped, has a tip. The tips are generally indicated at 36, 136, and are of metal or plastic to which the adhesive, after being subjected to sealing temperatures will not so adhere as to prevent the easy freeing of the end of the pull cord which is to be pulled.

In either of the above embodiments, the end of the cord 11, 111 which is to be pulled may protrude beyond the seal between the sections 30, 130 to the corresponding sections 32, 132. While such ends are exposed, that feature might result in the cords being prematurely pulled. It is, accordingly preferred that, see FIG. 8, that the exposed pull cord end 37 be of sufficient length to extend downwardly through the seal between the triangular sections 230 so as to be exposed within the gable 230 but requiring those sections to be spread apart before the exposed cord end 136 can be gripped.

Figure 9:
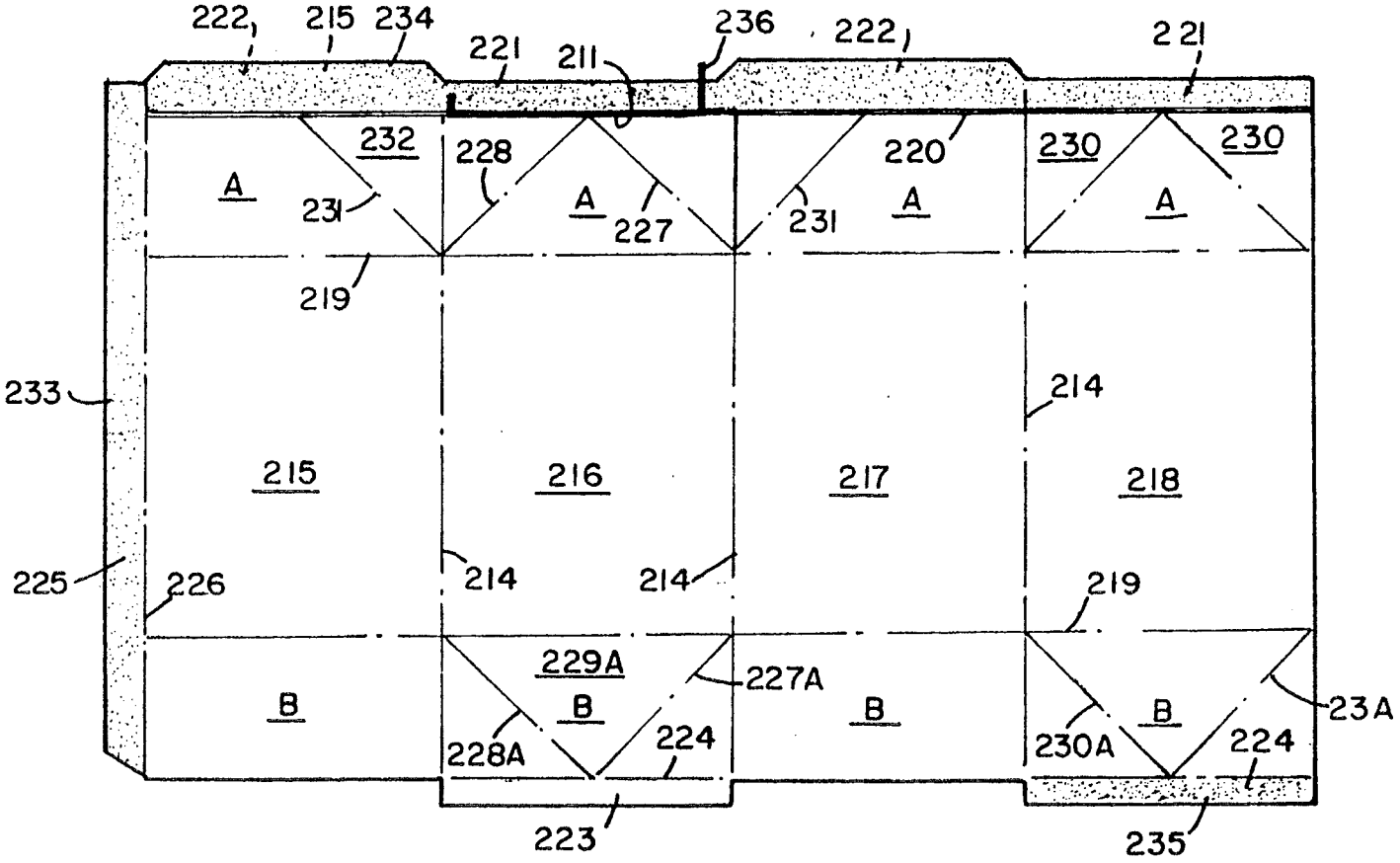
FIG. 9 is a view similar to FIG. 1 but showing the intermediate portion of the pull cord below the adhesive

The embodiment of the invention illustrated by FIG. 9 is generally similar to FIG. 1 and, accordingly, it will not again be detailed. Corresponding parts are identified by the same reference numerals which are distinguished by prefix additions -2-. It will be noted that the intermediate portion of the pull cord 211 is below the adhesive coat 234 and desirably in the fold line 220.

From the foregoing, it will be apparent that the invention eliminates all difficulties in opening gabled cartons without any objectionable production problems or costs.

I claim:

1. A carton for such liquids as milk and juices, said carton of a type formed from a substantially rectangular sheet having fold lines establishing integral front and back end walls and side walls, all of said walls having bottom portions folded and sealed together to provide a flat bottom, all of said walls also having upper portions with those of the side walls inclined towards each other, sealing means sealing the edges of said upper side wall portions together, the upper portion of each end wall having a central triangular section inclined towards the end wall of said carton and marginal, right triangular sections inclined upwardly and away from the central triangular section, said sealing means also sealing the edges of the triangular sections together, thereby forming end gables, and a pull cord having first and second ends and an intermediate length, said first end being anchored between one right triangular section of one gable and the inner surface of one side wall, the second end being digitally engageable adjacent the junction between the other right triangular section and the other side wall, said second end of said pull cord including a tip within said sealing means, said tip being not adhered to said sealing means, the intermediate length of said pull cord being disposed relative to the sealing means between the side walls and triangular sections in a manner ensuring that the sealing means between the triangular sections and the side walls will, when the pull cord is pulled towards the anchored end thereof, be at least so weakened that digital pressures on said right triangular section can readily convert said gable into a pouring spout.

2. The carton of claim 1 in which the intermediate length of the pull cord is within the adhesive sealing the right triangular sections of the front and side walls of said one gable.

3. The carton of claim 1 in which the intermediate length of the pull cord is below but close to the adhesive sealing the right triangular sections of the front and side walls of said one gable.

4. A carton for such liquids as milk and juices, said carton of a type formed from a substantially rectangular sheet having fold lines establishing integral front and back end walls and side walls, all of said walls having bottom portions folded and sealed together to provide a flat bottom, all of said walls also having upper portions with those of the side walls inclined towards each other, sealing means sealing the edges of said upper side wall portions together, the upper portion of each end wall having a central triangular section inclined towards the other end wall of said carton and marginal, right triangular sections inclined upwardly and away from the central triangular section, said sealing means also sealing the edges of the triangular sections together, thereby forming end gables, and a pull cord having first and second ends and an intermediate length, said first end being anchored between one right triangular section of one gable and the inner surface of one side wall, said second end of the pull cord extending downwardly at least part way through the sealing means joining the right triangular sections of the end wall of said one gable, the intermediate length of said pull cord being disposed relative to the sealing means between the side walls and triangular sections in a manner ensuring that the sealing means between the triangular sections and the side walls will, when the pull cord is pulled towards the anchored end thereof, be at least so weakened that digital pressures on said right triangular section can readily convert said gable into a pouring spout.

5. The carton of claim 4 in which the second end of the pull cord extends through the sealing means joining the right triangular sections of said end wall.

* * * * *